US005765510A

United States Patent [19]

Krowech et al.

[11] Patent Number: 5,765,510

[45] Date of Patent: Jun. 16, 1998

[54] RETRACTABLE, SEALED SOOTBLOWER FOR HIGH PRESSURE, HIGH TEMPERATURE APPLICATIONS

[75] Inventors: Robert J. Krowech, St. Louis Park; Michael J. Olson, New Hope, both of Minn.

[73] Assignee: DLTK, Inc., Minneapolis, Minn.

[21] Appl. No.: 638,452

[22] Filed: Apr. 26, 1996

[51] Int. Cl.[6] ..... F22B 37/18; F22B 37/48; F28G 1/00

[52] U.S. Cl. ..... 122/379; 122/390; 122/391; 122/392; 15/317

[58] Field of Search ..... 122/379, 390, 122/91, 392; 15/316, 317, 318

[56] References Cited

U.S. PATENT DOCUMENTS

| | | | |
|---|---|---|---|
| 803,562 | 11/1905 | Dean . | |
| 821,087 | 5/1906 | Charvat . | |
| 915,347 | 3/1909 | Hamann . | |
| 1,577,309 | 3/1926 | Sorensen . | |
| 1,614,502 | 1/1927 | Thomas . | |
| 1,978,555 | 10/1934 | Snow . | |
| 2,066,014 | 9/1936 | Pfleider | 15/317 |
| 2,109,855 | 3/1938 | Arey et al. . | |
| 2,112,896 | 4/1938 | Husband . | |
| 2,263,595 | 11/1941 | Sinkko . | |
| 2,309,889 | 2/1943 | Eves . | |
| 2,803,842 | 10/1957 | Fuller | 15/317 |
| 3,089,468 | 5/1963 | Clark . | |
| 3,123,132 | 3/1964 | Hedgecock . | |
| 3,541,999 | 11/1970 | Winkin et al. . | |
| 3,750,230 | 8/1973 | Reed | 122/390 |
| 3,835,817 | 9/1974 | Tuomaala . | |
| 4,018,267 | 4/1977 | Tomasicchio . | |
| 4,093,242 | 6/1978 | Terry . | |
| 4,257,355 | 3/1981 | Cook . | |
| 4,257,359 | 3/1981 | Capobianco . | |
| 4,333,742 | 6/1982 | Tanca | 122/390 |
| 4,421,067 | 12/1983 | Krowech | 122/390 |
| 4,583,496 | 4/1986 | Albers et al. | 122/390 |
| 5,040,262 | 8/1991 | Albers et al. | 15/317 |
| 5,097,564 | 3/1992 | Billings | 15/318 |
| 5,230,306 | 7/1993 | Barringer et al. | 122/392 |

*Primary Examiner*—Henry A. Bennett
*Assistant Examiner*—Jiping Lu
*Attorney, Agent, or Firm*—Reinhart, Boerner, Van Deuren Norris & Rieselbach, s.c.

[57] ABSTRACT

A retractable sootblower for avoiding and dislodging accumulated soot and ash. The sootblower includes an elongate housing and a blowing tube or blowing tube assembly reciprocable in the housing. The blowing tube is extended and retracted by pressurized gas. Pressurized gas is also applied to the sootblower. An internal gas channeling arrangement couples the pressurized gas to the blowing tube when the blowing tube is extended. The pressurized gas is thus discharged from the blowing tube when the blowing tube is extended. Additional structure is provided for rotating the blowing tube as it moves from the retracted position to the extended position.

24 Claims, 7 Drawing Sheets

RETRACTABLE, SEALED SOOTBLOWER FOR HIGH PRESSURE, HIGH TEMPERATURE APPLICATIONS

BACKGROUND OF THE INVENTION

This invention relates generally to gasifiers and heat recovery devices used in coal gasification processes and other high temperature, high pressure applications. More particularly, the invention relates to sootblowers used to avoid the accumulation of ash and soot at critical locations in such applications.

While the present invention is useful in a wide variety of processes, use of the invention in a coal gasification process is described herein for illustrative purposes. Coal gasification is a well known process for generating "coal gas," a methane-rich gas derived from coal. In this process, coal is partially combusted in a low oxygen atmosphere to heat the coal and drive off the coal gas. Due to limited available oxygen, the coal gas thus generated remains unburned and can be used as a fuel.

In a typical coal gasification process, the coal gas is initially generated at a high temperature and pressure. The high temperature condition requires a significant amount of energy that can be recovered using suitable heat recovery equipment and used to generate power or perform work. The handling of the high pressure, high temperature coal gas poses special problems, however. First, because coal gas is extremely flammable, it burns explosively if released to the relatively oxygen-rich ambient while still hot. Preventing such gas leakage requires sealing structures capable of withstanding the high temperature, high pressure environment. Finally, the coal gas typically entrains a considerable amount of soot and ash that tends to accumulate on and clog both gasifier devices and downstream heat recovery equipment.

Various forms of sootblowers have been proposed in the past for preventing accumulation of soot and ash on critical structures within gasifier and heat recovery structures. Such sootblowers typically direct a high pressure stream of cleansed gas against critical structures within the gasifier or heat recovery structures. The high pressure gas stream blows off accumulated soot and re-entrains the soot in the coal gas flow where it can be removed with suitable accumulators and filters. Effectiveness can be enhanced with rappers that knock against the critical structures to help dislodge accumulated soot and ash.

Examples of various forms of sootblowers and rappers are shown in U.S. Pat. No. 4,421,067 which is commonly owned by the assignee hereof. In these devices, various methods and structures are used to seal against the escape of high temperature, high pressure gas to the atmosphere. However, the sootblowers shown in the '067 patent at all times remain in place adjacent heat exchanger tubes within the heat recovery device and are only moved rotationally, not axially, in use. Although effective when used in heat recovery structures, such sootblowers are not optimally adapted for use in gasifiers where their continuous presence in the stream of hot gas flow can erode or otherwise damage the sootblower tubes.

SUMMARY OF THE INVENTION

The invention provides a retractable sootblower comprising a housing, an elongate, hollow blowing tube mounted in the housing for movement between an extended position and a retracted position, a gas inlet in the housing for receiving pressurized gas, and gas channeling structure within the housing and responsive to the position of the blowing tube for substantially channeling the pressurized gas through the blowing tube when the blowing tube is in the extended position, and for substantially limiting passage of the blowing gas through the blowing tube when the blowing tube is in the retracted position. In one preferred embodiment, the blowing tube can rotate through a prescribed arc or even 360 degrees as it extends.

The invention also provides a retractable sootblower mounted and sealed on a customer flange of a pressurized vessel. The retractable sootblower includes an elongate housing having a closed rear end and an open front end. The front end includes a front flange for engaging and securing to the customer flange in sealed relationship therewith. The sootblower further includes a piston mounted for axial, reciprocating movement within the housing and a hollow, elongate blowing tube within the housing. The blowing tube has a rear end coupled to the piston and a forward end projectable through the front flange. The blowing tube is thereby axially movable relative to the housing in response to axial movement of the piston. The sootblower further includes a center bushing in the housing between the rear end of the housing and the front end of the housing and engaging the blowing tube. The center bushing thereby divides the housing into a forward chamber and a rear chamber with the piston being contained in, and reciprocable in, the rear chamber and with the blowing tube extending through the forward chamber. A gas inlet is provided for introducing pressurized gas into the forward chamber. An inlet opening is provided in the blowing tube communicating with the hollow interior of the blowing tube. The inlet opening is positioned on the blowing tube so that the center bushing isolates the inlet opening from the forward chamber when the piston is adjacent the rear end of the housing and so that the inlet opening is exposed in the forward chamber when the piston is adjacent the center bushing. Structure is provided for controllably moving the piston in the rear chamber (a) toward the center bushing to thereby simultaneously extend the blowing tube relative to the housing and expose the inlet opening in the forward chamber and (b) toward the rear end of the housing to thereby simultaneously retract the blowing tube and isolate the inlet opening from the first chamber.

The invention also provides a blowing tube assembly for use in a retractable sootblower. The blowing tube assembly includes an elongate hollow tube having a rear end and a forward end, a piston coupled to the rear end of the tube, a discharge opening in the tube adjacent the forward end and communicating with the hollow interior of the tube, an inlet opening in the tube spaced from the discharge opening in a direction toward the rear end and communicating with the hollow interior of said tube, and a rear seal in the tube spaced from the inlet opening in a direction toward the rear end for sealing the rear end of the tube.

The invention also provides a rotatable, retractable cylinder for extending and retracting the blowing tube of a retractable sootblower and for rotating the blowing tube around its axis as the blowing tube is extended. The cylinder includes a cylinder housing, a cylinder rod extendable and retractable relative to the cylinder housing, and structure responsive to movement of the cylinder rod relative to the cylinder housing for rotating the cylinder rod relative to the cylinder housing as the cylinder rod extends relative to the cylinder housing. In another preferred embodiment, the structure for rotating the cylinder rod relative to the cylinder housing includes one or more splines on either of the cylinder rod or the cylinder housing.

It is an object of the present invention to provide a new and improved sootblower for gasifiers, heat recovery devices and other high temperature and/or high pressure applications.

It is a further object of the present invention to provide a new and improved sootblower that is effective and durable for use in high pressure, high temperature gas streams entraining significant quantities of ash and soot.

It is a further object of the present invention to provide a new and improved sootblower that maintains a positive seal against the escape of high pressure gas and that avoids the use of flexible, ring-shaped seals that encircle a movable element.

It is a further object of the present invention to provide a new and improved sootblower that provides combined axial and rotary movement of the blower tube when actuated.

It is a further object of the present invention to provide a new and improved sootblower that does not supply pressurized gas to a lance until the tip of the lance clears a refractory lining of a vessel.

It is a further object of the present invention to provide a new and improved sootblower operating on high pressure natural gas.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DESCRIPTION OF PREFERRED EMBODIMENTS

Figure 1:
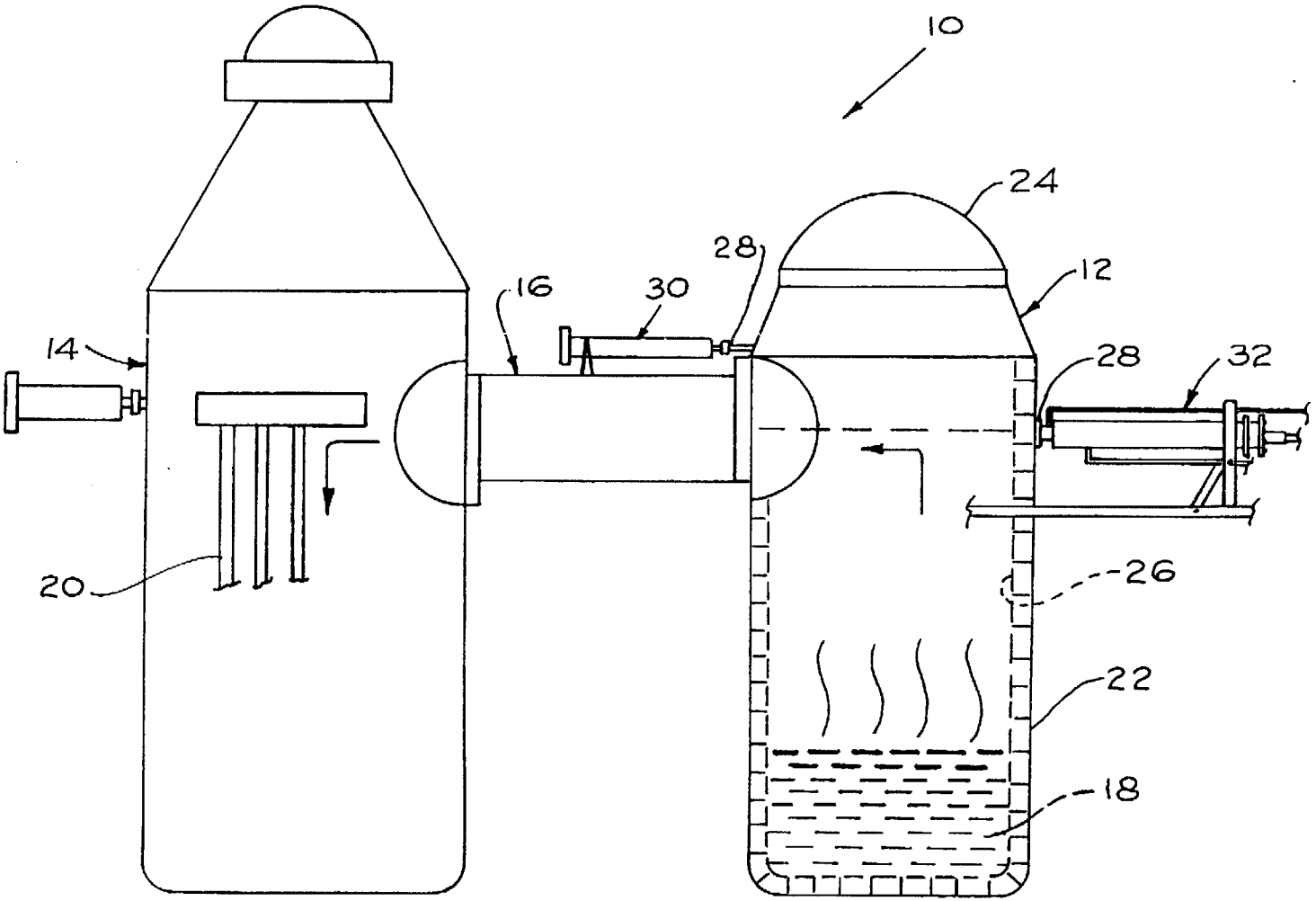
FIG. 1 is a side elevation view, partially in section, of a coal gasification system having a pair of retractable, sealed sootblowers constructed in accordance with one preferred embodiment of the invention.

Referring to the drawings, and, more particularly to FIG. 1, a coal gasification system is illustrated at 10. The gasification system includes a gasifier 12 interconnected with a heat exchanger 14 through an interconnecting duct 16. Coal 18 within the gasifier 12 is partially burned in a controlled, reduced oxygen atmosphere driving off methane-rich coal gas. The hot coal gas thus produced pressurizes the gasifier 12 and is conducted via the duct 16 to the heat exchanger 14. Typically, pressures in the gasifier range from 60 to 600 psig at high temperatures.

The heat exchanger 14 is provided with a series of tubes or pipes 20 through which water and steam circulate. Heat from the hot coal gas is transferred to the water in pipes 20 to produce steam which can then be used to produce power or perform work. In this way, the hot coal gas is cooled to useful temperatures and the energy recovered in a useful and efficient manner.

The gasification process also generates a considerable amount of soot and ash. The soot and ash are carried by the coal gas throughout the gasifier 12 and heat exchanger 14. Although suitable soot and ash filters (not shown) are provided in a known manner for removing soot and ash from the coal gas downstream of the gasifier 12 and before leaving the heat exchanger 14, soot and ash entrained in the hot gas tends to accumulate on interior surfaces of the gasifier 12 and heat exchanger 14 before reaching the filters. If not periodically removed, the accumulated ash and soot can clog interior portions of the gasifier 12, heat exchanger 14 and duct 16.

The gasifier 12 includes a pressure vessel 22 having a domed cover or roof 24. The pressure vessel 22 is lined with a refractory material 26 and is configured to contain the heated, pressurized coal gas without leakage. For a number of reasons, it is often desirable to gain access to the interior of the vessel without compromising its ability to hold pressure. Accordingly, the pressure vessel contains one or more customer flanges 28 that communicate with the interior of the vessel 22 and provide a mounting surface against which external structures can be fastened. When an external device is fastened to a customer flange 28, the device and the flange 28 can form an enclosed structure that effectively seals the vessel against the escape of pressurized gas.

In the illustrated gasification system 10, the present invention can prevent accumulation of soot and ash in the gasifier pressure vessel 22 adjacent the duct 16 or in virtually any other desired location. A pair of extendible and retractable sootblowers 30, 32, each embodying various features of the invention, are mounted adjacent the upper end of the pressure vessel 22. One of the sootblowers 30 is mounted above and substantially parallel to the duct 16. This sootblower 30 functions primarily to direct a jet of pressurized gas upwardly to remove soot and ash from the domed roof 24 of the vessel 22. The other sootblower 32 is positioned diametrically opposite the duct 16 in substantially coaxial alignment therewith. This sootblower 32 directs a jet of pressurized gas toward the opening of the duct 16 to keep the duct 16 clear of accumulated soot and ash. Both sootblowers 30, 32, function primarily to keep the soot and ash entrained in the stream of pressurized gas until the soot and ash can be removed by downstream accumulators and filters. Preferably, the sootblowers 30, 32 are bolted or otherwise fastened to existing customer flanges 28 on the vessel 22. Alternatively, suitable flanges 28 can be installed on the vessel 22 at the appropriate locations. Of course, each sootblower 30, 32 can be mounted in a wide variety of locations as desired in each gasification system 10 or other application of the invention.

Figure 2:
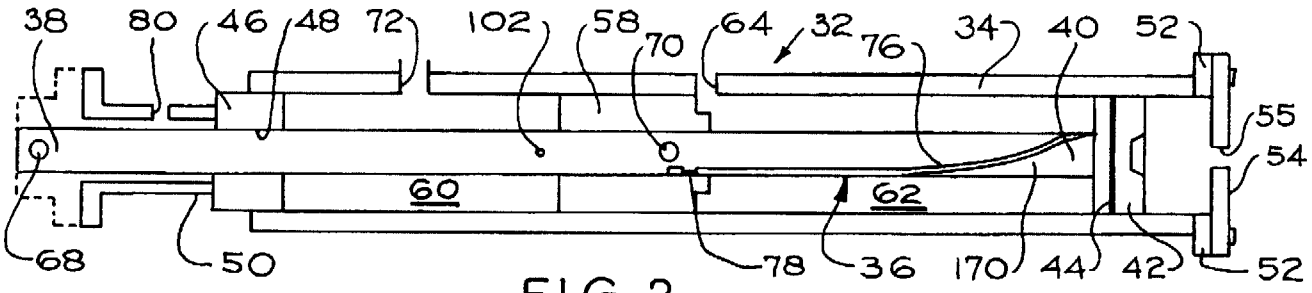
FIG. 2 is a compressed side view, in section, of a retractable, sealed sootblower constructed in accordance with a preferred embodiment of the invention.

A highly preferred structure of each sootblower 30, 32 is shown in FIG. 2. Each sootblower includes a hollow, substantially cylindrical body or housing 34 that contains a blowing tube or lance assembly 36 mounted for reciprocation therein. The blowing tube assembly 36 includes a forward or inner end 38 that is extendible into the interior of the vessel 22 and a rearward or outer end 40 that remains at all times within the housing 34. The outer end 40 of the blowing tube assembly 36 includes a piston 42 having a sealing ring 44 extending around its outer periphery. The piston 42 and sealing ring 44 form a close, substantially gas tight fit with the interior of the housing 34. Preferably, the interior of the housing 34 and the outer periphery of the piston 42 are polished to improve the seal between the piston 42 and the housing 34.

The forward end of the housing 34 includes a front bushing 46 defining a center passageway 48 through which the forward end 38 of the blowing tube assembly 36 extends. The forward end of the bushing 46 is joined to a front flange 50 that mates with the customer flange 28 of the vessel 22 to form a pressure tight seal. The rearward end of the housing 34 includes a rear flange 52 that is closed off with an end plate 54. The rear flange 52 includes a port 55 to which a gas fitting 56 (see FIG. 4) can be mounted to pressurize the area behind the piston 42 and thereby drive the blowing tube assembly 36 forwardly in the housing 34. A center bushing 58 within the housing 34 supports the blowing tube assembly 36 between its ends and effectively divides the interior of the housing into a forward chamber 60 and a rear chamber 62. A port 64 is provided through the side of the housing immediately behind the center bushing 58. A gas fitting 66 (see FIG. 4) can be mounted in the port 64 to pressurize the area ahead of the piston 42 to thereby drive the blowing tube assembly 36 rearwardly within the housing 34.

It will be understood that the blowing tube assembly 36 can be extended or retracted relative to the housing 34 by alternately pressurizing the areas behind or ahead of the piston 42. When pressurized gas is introduced behind the piston 42 to drive the blowing tube assembly 36 forwardly, gas ahead of the piston 42 and behind the center bushing 58 is exhausted through the port 64 and gas fitting 66 adjacent the center bushing 58. When pressurized gas is introduced ahead of the piston 42 to drive the blowing tube assembly 36 rearwardly in the housing 34, gas behind the piston 42 is exhausted through the port 55 and gas fitting 56. Accordingly, ports 55 and 64 can be used alternately as gas inlet or gas outlet ports as required to drive the blowing tube assembly 36 either forwardly or rearwardly within the housing 34. When the blowing tube assembly 36 is driven forwardly, the forward end 38 projects through the forward bushing 46, the forward flange 50 and the customer flange 28 into the interior of the vessel 22.

The blowing tube assembly 36 preferably comprises an elongate, hollow, cylindrical tube of smaller diameter than the interior diameter of the housing 34. A forward opening 68 is formed adjacent the tip of the forward end 38 of the blowing tube assembly 36 and opens into the hollow interior of the blowing tube assembly. A rear opening 70 is formed in the blowing tube assembly 36 at a point spaced from the forward opening 68 and also opens into the hollow interior of the blowing tube assembly 36. The rear opening 70 is located so that the rear opening 70 is occluded by the center bushing 58 when the blowing tube assembly is in the retracted position shown in FIG. 2. The center bushing 58 and location of the rear opening 70 are preferably selected to prevent pressurized gas from impinging upon refractory or other linings of the vessel 22 located at the customer flange 28.

Figure 4:
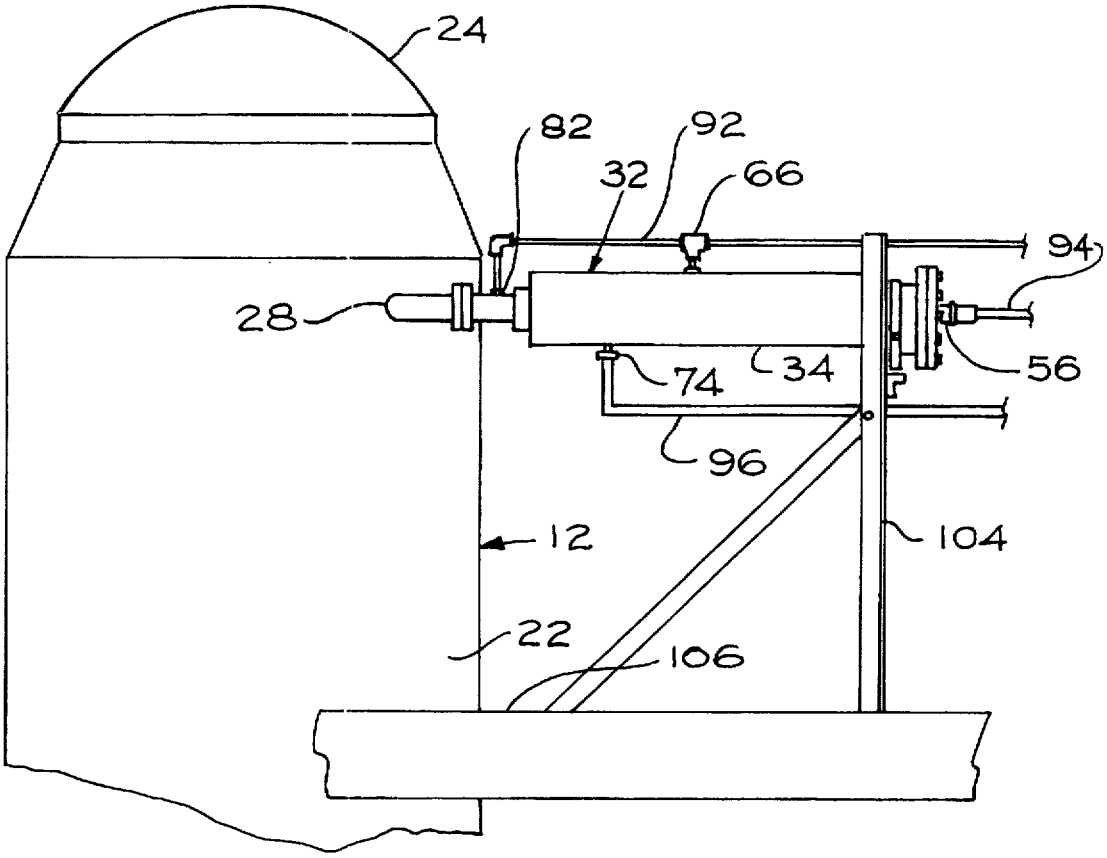
FIG. 4 is a side elevation view of the sootblower showing the sootblower mounted to a gasification vessel in the coal gasification system shown in FIG. 1.

A port 72, to which a gas fitting 74 (as shown in FIG. 4) can be mounted, is formed in the sidewall of the housing 34 and opens into the forward chamber 60 ahead of the center bushing 58. Pressurized gas for dislodging soot and ash is introduced into the forward chamber 60 through the gas fitting 74 and port 72. When the blowing tube assembly 36 is in the retracted position shown in FIG. 2, the center bushing 58 covers the rear opening 70 in the blowing tube assembly 36 and the pressurized gas is substantially confined within the forward chamber 60. However, when the blowing tube assembly 36 is extended enough to expose the rear opening 70 within the forward chamber 60, the blowing gas in the forward chamber passes through the rear opening 70, into and through the hollow interior of the blowing tube assembly 36, and out the forward opening 68.

Preferably, the blowing tube assembly 36 is configured to rotate around its longitudinal axis as it extends. Accordingly, the outer surface of the blowing tube assembly 36 includes a spiral groove 76 and the center bushing 58 includes a guide pin 78 that rides in the groove 76 as the blowing tube assembly 36 extends. As the blowing tube assembly 36 extends, the guide pin 78 and groove 76 cam the blowing tube assembly 36 over so as to rotate the blowing tube assembly 36 around its axis. The amount of rotation thus provided, as well as where such rotation occurs in relation to the extension of the blowing tube assembly 36, can be controlled by controlling the shape or path of the groove 76 on the blowing tube assembly 36.

As shown in FIG. 2, the front flange 50 includes a port 80 to which still another gas fitting 82 (see FIG. 4) can be mounted. The port 80 and gas fitting 82 permit pressurized gas to be introduced into the interior of the front flange 50. Gas thus introduced to the front flange passes around the forward end 38 of the blowing tube assembly 36 and into the interior of the vessel 22. This serves as a sink for exhaust gases that are developed as the blowing tube assembly 36 is extended and retracted. The exhaust gases can also be channeled to nozzles 122 or openings around or at the blowing tube assembly 36 or the customer flange 28 to clean the assembly 36 and/or customer flange 28 of soot deposits. This channeling prevents soot buildup and blockage of the assembly 36, increasing the reliability and performance of the soot blowers 30, 32.

Figure 3:
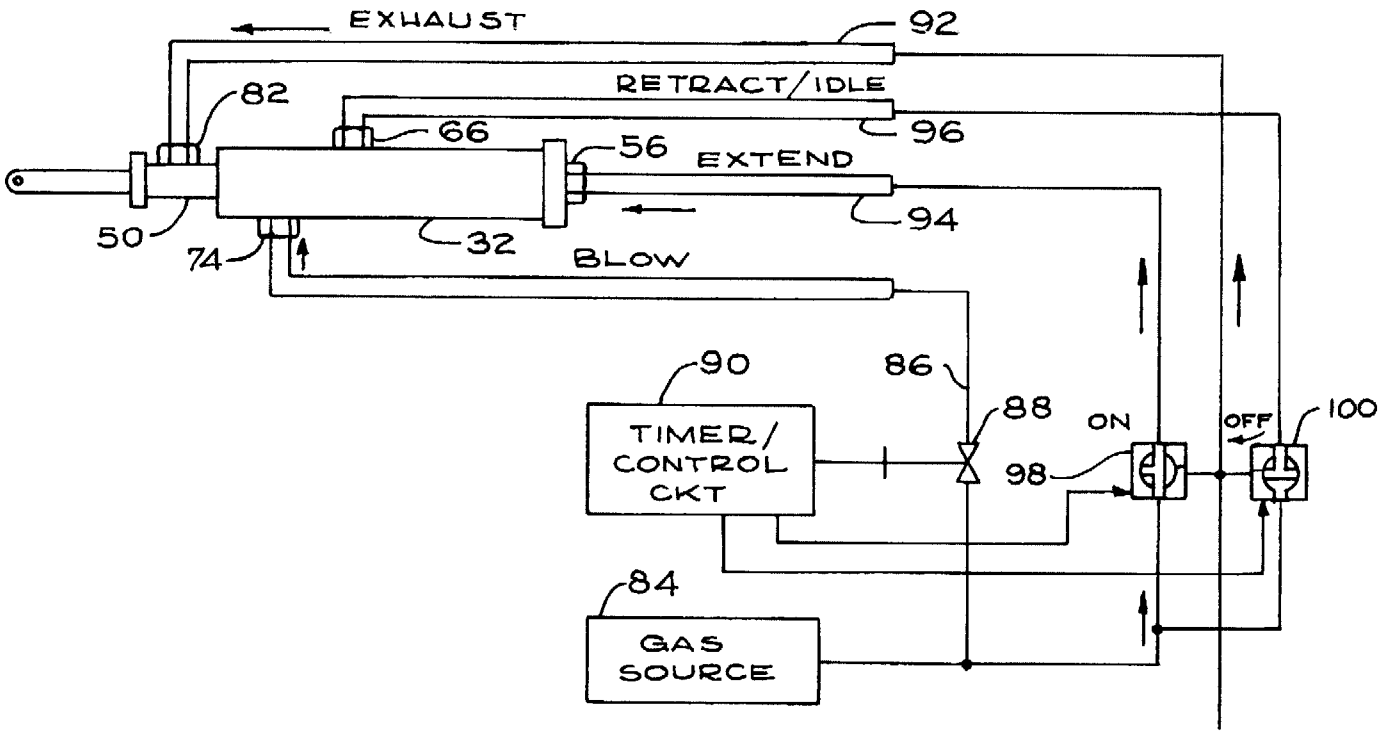
FIG. 3 is a schematic diagram of an automatically controlled fluid system valving and piping arrangement associated with the sootblower shown in FIGS. 1 and 2.

A system for automatically operating each sootblower 30, 32 is shown schematically in FIG. 3. As shown, a pressurized gas supply 84 is coupled to the forward chamber 60 of the housing 34 through a gas line 86 and the gas fitting 74. A shut off valve 88 in the gas line 86 controls the application of pressurized gas to the forward chamber 60. Preferably, the pressurized gas comprises pressurized coal gas that has already been generated in the gasification process. The coal gas is preferably filtered or otherwise cleansed prior to entering the sootblowers 30, 32. In one preferred embodiment, coal gas at about 300 degrees Fahrenheit and 800 psig is used as the pressurized gas. It will be appreciated that other types of pressurized gas can be used. The shut off valve 88 is preferably controlled by a timer circuit 90 that automatically opens the shut off valve 88 at desired times. Alternatively, the pressurized gas system can be manually controlled with manually actuated switches and valves directing the gas flow.

An exhaust gas line 92 is coupled to the interior of the front flange 50 through the gas fitting 82. An extend gas line 94 is coupled to the rear end of the rear chamber 62 through the gas fitting 56. A retract/idle gas line 96 is coupled to the front end of the rear chamber 62 through the gas fitting 66. The extend gas line 94 is connected to a first directional control valve 98. The first directional control valve can be operated to couple the extend gas line 94 to either a source of pressurized gas (e.g. pressurized coal gas generated in the gasification process shown as the gas supply 84 in FIG. 3) or to the exhaust gas line 92. The retract/idle gas line 96 is connected to a second directional control valve 100 that can be operated to couple the retract/idle gas line 96 to either the gas supply 84 or to the exhaust gas line 92. The first and second directional control valves 98, 100 operate in conjunction with each other so that when one of the lines 94 or 96 is coupled to the gas supply 84, the other line is coupled to the exhaust line 92. The first and second directional control valves 98, 100 are coupled to, and controlled by, the timer circuit 90.

As shown in FIGS. 2 and 3, when the sootblower 30 or 32 is initially in an idle, nonblowing mode, the blowing tube assembly 36 is fully retracted. Pressurized gas is applied through the retract/idle line 96, and the extend line is coupled to the exhaust line 92. Gas pressure in the forward end of the rear chamber 62 drives the piston 42 toward the rear end of the housing 34 and retains it in the fully retracted position. The shut off valve 88 ordinarily remains closed even in the idle mode, so that blowing gas pressure is maintained in the forward chamber 60. In the retracted position, the rear opening 70 in the blowing tube assembly 36 is covered by the center bushing 58, which keeps the pressurized gas from passing through the opening 70 into the hollow interior of the blowing tube assembly 36. However, to help cool the tip of the blowing tube assembly which may remain exposed to some of the harsh conditions in the gasifier vessel 22 even when the blowing tube assembly 36 is fully retracted, some of the pressurized gas is preferably permitted to flow past the exterior and interior sides of the blowing tube assembly tip. To this end, a small idle port 102 is formed through the side of the blowing tube assembly 36 forward of the opening 70. Unlike the opening 70, the idle port 102 is forward of, and hence not covered by, the center bushing 58 when the blowing tube assembly 36 is fully retracted. Thus, the idle port 102 is exposed to the pressurized blowing gas in the forward chamber 60 permitting some of the gas to pass through the interior of the blowing tube assembly 36 and out the forward opening 68. The size of the idle port 102 is gauged to limit the flow of pressurized gas to only that necessary to cool the blowing tube assembly tip. Additionally, a small amount of pressurized gas escapes past the forward bushing 46 through the clearance between the bushing 46 and the blowing tube assembly 36. This escaping gas helps cool the exterior of the blowing tube assembly tip. The blowing gas that escapes past the bushing 46, as well as that which passes through the idle port 102, ultimately enters the gasifier vessel 22 through the customer flange 28.

To actuate the sootblowers 30, 32, the first and second directional control valves 98, 100 are actuated to couple the extend line 94 to the gas supply 84 and to couple the retract/idle line 96 to the exhaust line 92. Pressurized gas applied to the rear of the rear chamber 62 drives the piston 42 forward to extend the blowing tube assembly 36. Gas displaced from the forward end of the rear chamber 62 is exhausted through the exhaust line 92 into the front flange 50 and from there ultimately into the gasifier vessel 22. Pressures in the gasifier chamber 22 are generally significantly lower than pressures used to operate the sootblower and developed in the exhaust line 92. When the blowing tube assembly 36 extends sufficiently to clear the center bushing 58 and expose the rear opening 70, pressurized gas escapes in significant quantities through the rear opening 70 and out the forward opening 68. The resulting blast of gas at the forward opening 68 dislodges accumulated soot and ash from the interior of the gasifier vessel 22. As the blowing tube assembly 36 continues to extend, the spiral groove 76 and guide pin 78 rotate the blowing tube assembly 36 directing the pressurized gas over different parts of the gasifier vessel interior to further enhance sootblowing effectiveness. When it is desired to retract the sootblower, the first and second directional control valves 98, 100 are actuated to couple the retract/idle line 96 to the gas supply 84 and to couple the extend line 94 to the exhaust line 92. The pressurized gas drives the piston 42 rearwardly in the housing 34 and the gas displaced in the rear end of the rearward chamber 62 is exhausted through the exhaust line 92. As the rear opening 70 enters the center bushing 58, the escape of pressurized gas through the rear opening 70 is cut off.

A preferred mounting configuration by which each sootblower 30, 32 is mounted to the gasifier 12 is illustrated in FIG. 4. The sootblower 32 is supported in a generally horizontal orientation by a support 104 that in turn is supported by a deck 106 installed adjacent the gasifier 12. The support 104 extends upwardly from the deck 106 and supports the rear end of the sootblower housing 34. The forward end of the housing is supported by the customer flange 28 to which it is bolted, welded or otherwise conventionally securely attached. The support 104 also supports the gas lines 92, 94 and 96 that are connected to the sootblower 32. The other sootblower 30 can be supported by means of a similar support extending upwardly from the duct 16.

Figure 5:
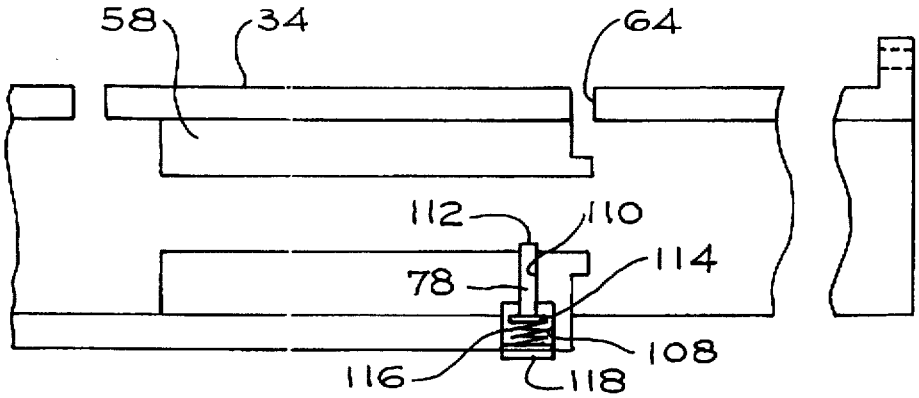
FIG. 5 is a fragmentary side view, partially in section, of a guide pin assembly used in the sootblower to help achieve rotary movement of the sootblower as it extends axially.

A preferred embodiment of the guide pin 78 is shown in FIG. 5. The guide pin 78 is received in a recess 108 formed through the side of the housing 34 and into the center bushing 58. A relatively smaller clearance port 110 opens through the center bushing 58 and allows the tip 112 of the guide pin 78 to project into the interior of the housing 34. A head 114 at the lower end of the guide pin 78 keeps the guide pin from passing filly through the port 110, and a spring 116 under the head biases the guide pin upwardly into the housing 34. A removable screw cap 118 under the spring 116 partially compresses the spring 116 to create the bias force and seals off the recess 108. By removing the screw cap 118, the spring 116 and guide pin 78 can be easily replaced to simplify maintenance without requiring substantial disassembly of the sootblower 30, 32.

Figure 6:
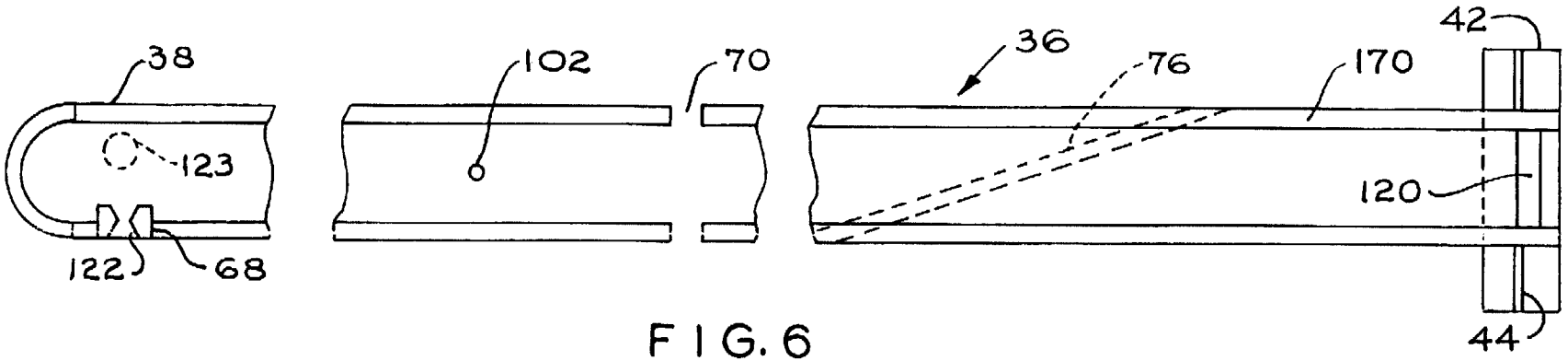
FIG. 6 is a perspective view, partially in section, of a blower tube assembly or lance incorporated in a sootblower.

A preferred embodiment of the blowing tube assembly 36 is shown in FIG. 6. The blowing tube assembly 36 comprises a hollow tube 170 formed of stainless steel or similar durable, corrosion resistant metal, such as Incoloy 800 HT brand chrome-nickel alloy available from Inco Alloys International. The piston 42 is preferably welded to the rear end of the tube 170, as is an end plate or seal 120 that seals the end of the tube. The spiral groove 76 is milled into the exterior of the tube 170. Preferably, one or more nozzles 122 are conventionally mounted in one or more forward openings 68 and are shaped so as to concentrate and direct the stream of pressurized gas as desired. The nozzle location flexibility and rotating capability of this preferred embodiment increase the effectiveness of the blowing tube assembly 36.

In one preferred embodiment, the blowing tube assembly 36 has an overall length of approximately 8 feet, 7 inches and has an effective diameter of about two and one-half inches. The center bushing 58 is preferably located to enable the tube 170 to extend approximately 3 feet and rotate about 180 degrees. The groove 76 is shaped so that the rotation occurs substantially during the last foot of extension. It will be appreciated that, although these details have been provided for purposes of describing a preferred embodiment, these details are not critical to the invention in its broader aspects.

Figure 7:
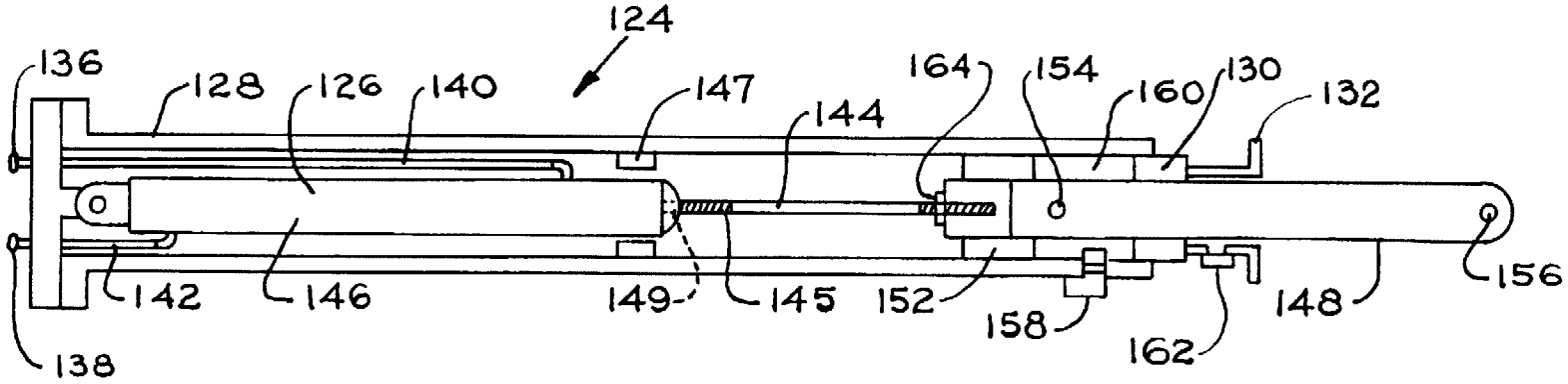
FIG. 7 is a compressed side view, in section, of an alternative embodiment of a retractable, sealed sootblower constructed in accordance with another form of the invention.

An alternate embodiment sootblower 124 is shown in FIG. 7. In this preferred embodiment, an extendible cylinder 126 is mounted in an elongate housing 128. The housing 128 includes a front bushing 130 and a front flange 132 that can be mated to a customer flange 28 on the gasifier 12 in a similar manner as the previously described sootblowers 30, 32. The rear end of the housing 128 is sealed with an end cap 134 having a pair of gas fittings 136, 138 that interconnect with the cylinder 126 through respective gas lines 140, 142. Using a control system similar to that shown in FIG. 3, pressurized gas can be supplied to, and exhausted from, the cylinder 126 in two directions to extend and retract the cylinder 126. In accordance with one form of the invention, the cylinder 126 is constructed so that the rod 144 of the cylinder 126 rotates as it extends from the housing 146 of the cylinder 126. This can be achieved, for example, by providing one or more spiral splines 145 on the rod 144 that engage complementary grooves 149 on the cylinder housing and twist the rod 144 as it extends from the cylinder housing. Alternatively, any of the sootblower embodiments described herein can include one or more reaction nozzles 123 (shown in phantom in FIG. 6) to rotate the blowing tube assembly 36 about its longitudinal axis through angles of up to 360 degrees or more. As illustrated, the rear end of the cylinder 126 is attached to the end cap 134, and the forward end of the cylinder 126 is supported by an interior bushing 147 within the housing 128.

The forward end of the cylinder rod 144 is connected to the rear end of an elongate, hollow blowing lance or tube 148 that is preferably formed of a durable metal such as Incoloy 800 HT brand chrome-nickel alloy. The tube 148 is supported for axial and rotational movement relative to the housing 128 by means of the forward bushing 130 and a rear bushing 152 mounted within the housing 128. The tube 148 includes a rear opening 154 and a forward opening 156. Each opening 54, 156, opens into the hollow interior of the blowing tube 148. Pressurized gas is applied through a gas fitting 158 to the chamber 160 defined within the housing 128 between the forward and rear bushings 130, 152.

When the cylinder 126 is retracted, the rear opening 154 is to the left of the rear bushing 150 as seen in FIG. 7, which prevents the pressurized gas from reaching the opening 154. When the cylinder 126 extends sufficiently to drive the rear opening 154 past the rear bushing 150 and into the chamber 160, the pressurized gas flows into the rear opening 154, through the hollow interior of the tube 148, and out the forward opening 156. At the same time, the tube 148 rotates to direct the stream of blowing gas where desired. When the tube 148 retracts, the escape of pressurized gas ceases as the rear opening moves past the rear bushing 150. A gas fitting 162 into the front flange 132 provides a sink into which exhaust gas can be directed. Preferably, the rod 144 threadedly engages the rear end of the tube 148 to permit adjustment of the linear position of the tube 148 relative to the housing 128 and the cylinder 126. A lock nut 164 is provided for locking the rod 144 to the tube 148 after such adjustment is made.

The alternative embodiment sootblower 124 is advantageous in that the cylinder 126 can be fabricated separately from the blowing tube 148. By using only one, or a few, cylinder designs in combination with tubes 148 of various sizes and lengths, sootblowers 124 of various sizes can economically be made on a custom or semicustom basis while enjoying the manufacturing economy that results from making the cylinders 126 in quantity and to one design. It will be appreciated that various modifications can be made to the alternative embodiment sootblower 124 without departing from the invention.

Figure 8:
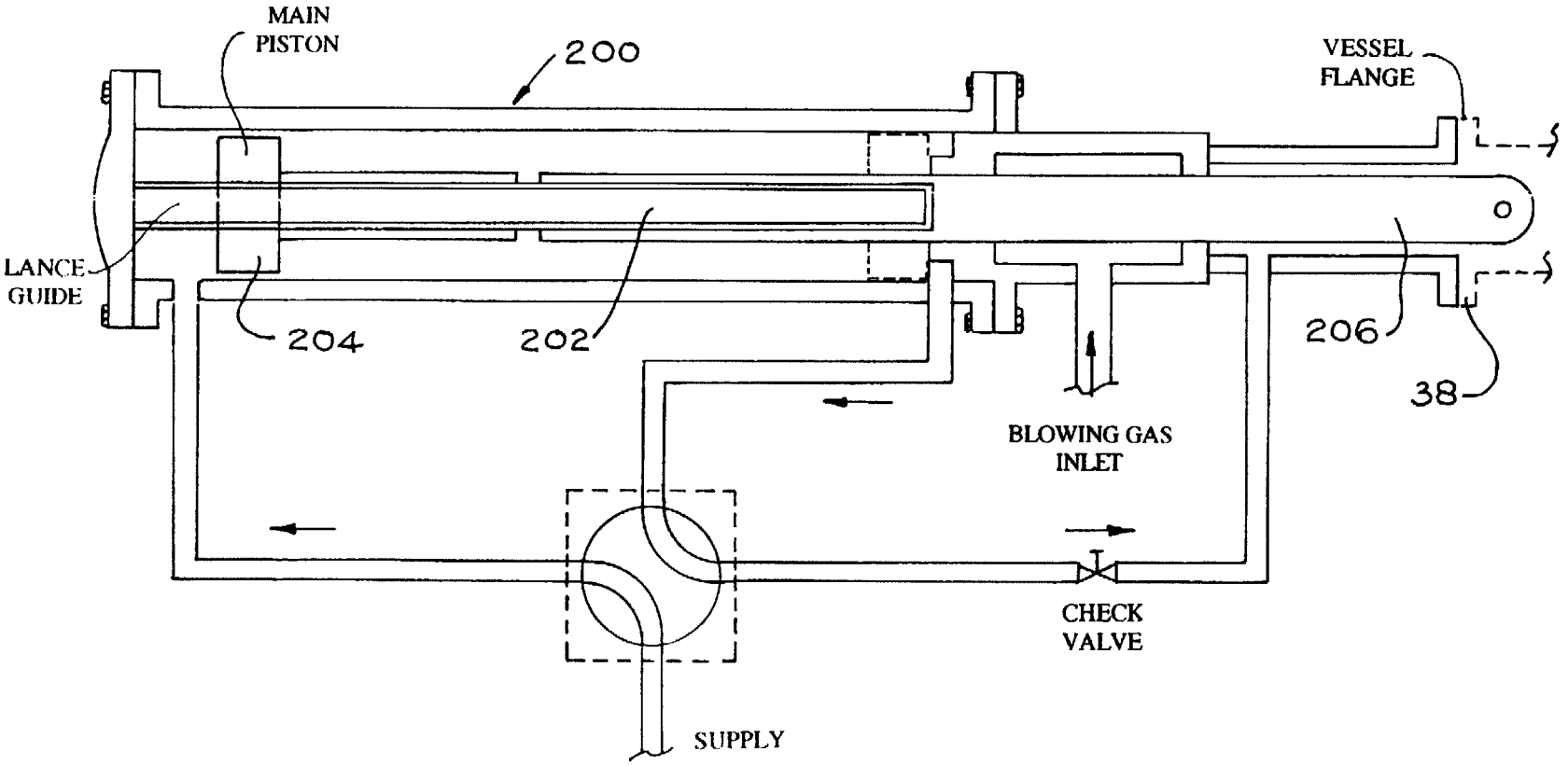
FIG. 8 is a side elevation view, partially in section, of another alternative embodiment of the invention.
Figure 9:
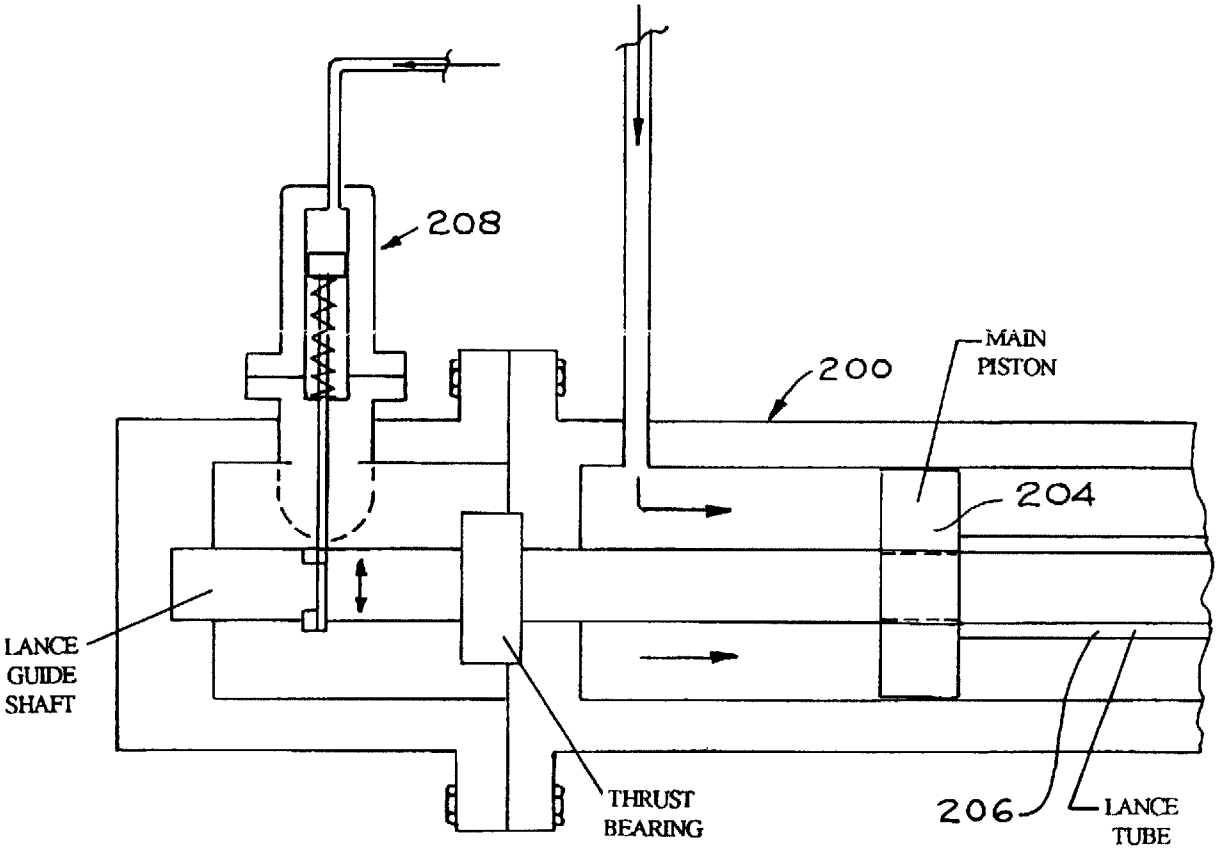
FIG. 9 is a side elevation view, in section, of another alternative embodiment of the invention including a rotation cylinder.

Yet another alternative embodiment of the invention is shown in FIGS. 8 and 9. The sootblower 200 includes a telescoping assembly 202. The telescoping assembly 202 includes a main piston 204 dimensioned to fit over a lance guide 206 for axial extension thereon. The sootblower 200 is connected to the customer flange 38 in the same way as described hereinbefore. Pressurized gas is introduced in a similar manner to that described previously, with the inlet ports adjusted as shown in FIGS. 8 and 9. The pressurized gas is directed to the back side of the main piston 204 to move it forward, thereby moving the lance 206 forward as well.

Rotation of the lance 206 can be accomplished in a variety of ways. For example, the main piston 204 can be coupled to the lance 206 via conventional splines or key 208 ways and keys. The main piston 204 can then be rotated on conventional thrust bearings via a pneumatic cylinder 208 such as the one shown in FIG. 9 or by other conventional means. The pneumatic cylinder 208 can be actuated by coal gas or other gas as desired.

Figure 10:
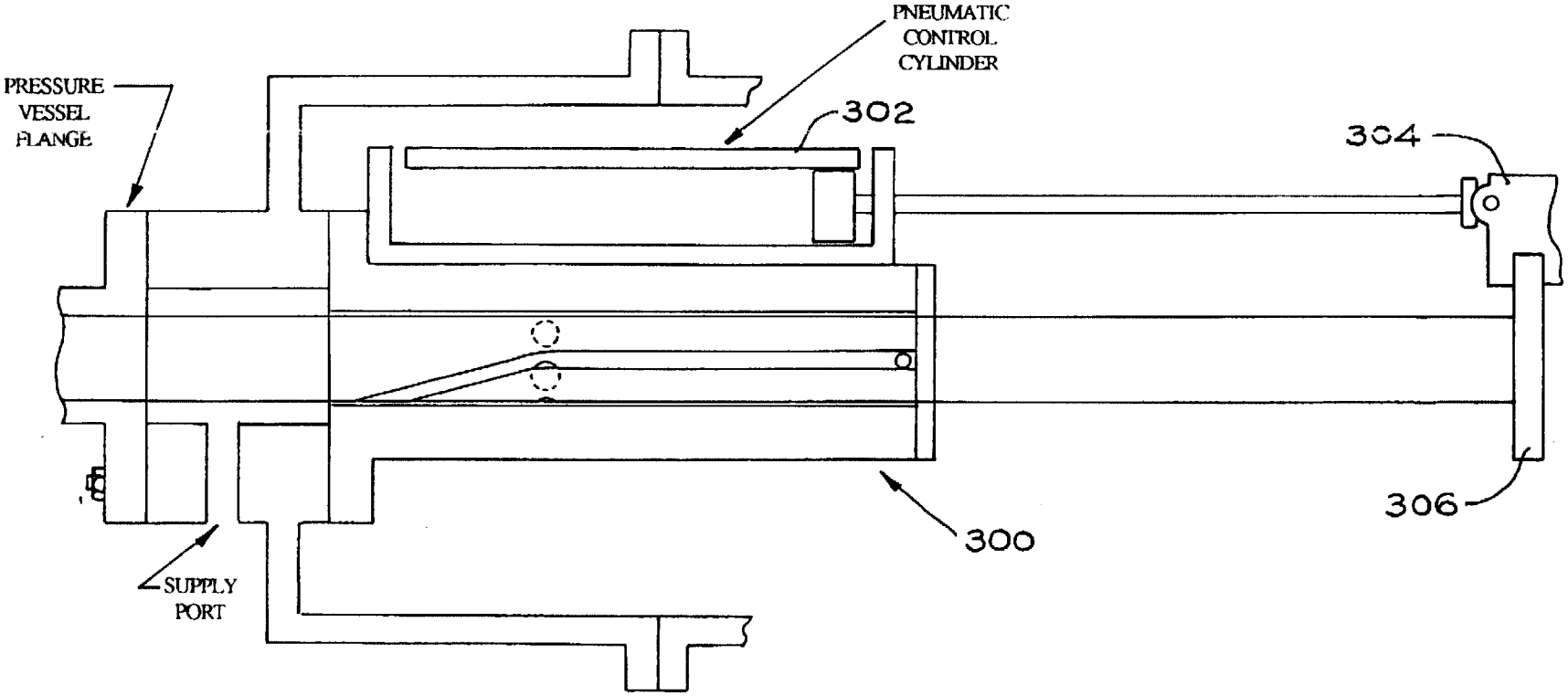
FIG. 10 is a side elevation view, partially in section, of another alternative embodiment of the invention including another cylinder mounting configuration.

Referring to FIG. 10, another alternative embodiment sootblower 300 is shown. This alternative embodiment utilizes a pneumatic control cylinder 302 coupled with its longitudinal axis parallel to the longitudinal axis of the sootblower 300. The pneumatic control cylinder 302 can be actuated using coal gas or other gas as desired. The pneumatic control cylinder 302 includes a clevis 304 coupled to an annular flange 306 at the rear of the sootblower 300. The pneumatic control cylinder 302 controls the axial extension and retraction of the sootblower 300, while a guide pin and slot configuration (as described herein before) provides rotation of the lance 308 through a prescribed arc as desired. Other aspects of the sootblower 300 are identical to or similar to the other preferred embodiments of the invention previously described herein.

Although the sootblowers described herein have been shown mounted to the vessel of a gasifier used in a coal gasification process, it will be appreciated that the sootblowers are not limited to use in such processes but can be used in other types of boilers, gasifiers, heat exchangers or any other such devices where it is desired to dislodge accumulated particles from the interior structure of a sealed vessel without breaching the sealed integrity of the vessel. Accordingly, the context in which the sootblowers have been shown and described is intended to be illustrative rather than limiting.

While a particular embodiment of the invention has been shown and described, it will be obvious to those skilled in the art that changes and modifications can be made without departing from the invention in its broader aspects, and, therefore the aim in the appended claims is to cover all such changes and modifications as fall within the true spit and scope of the invention.

What is claimed is:

1. A retractable sootblower comprising:

an elongate housing having first and second ends;

an elongate, hollow blowing tube mounted in said housing for movement between an extended position and a retracted position;

a gas inlet in said housing for receiving pressurized blowing gas; and a gas channeling structure within said housing and responsive to the position of said blowing tube for substantially channeling the blowing gas through said blowing tube when said blowing tube is in said extended position and for substantially limiting passage of the blowing gas through said blowing tube when said blowing tube is in said retracted position, said gas channeling structure including a stationary member within said housing located between said first and second ends of said housing, said stationary member dividing said housing into first and second chambers, the first chamber being communicated with said gas inlet, and an inlet opening in said blowing tube communicating with the interior of said blowing tube, said inlet opening being positioned on said blowing tube so that said stationary member isolates said inlet opening from said first chamber when said blowing tube is in said retracted position, and said inlet opening is exposed in said first chamber when said blowing tube is moved away from said retracted position.

2. A retractable sootblower as defined in claim 1 wherein said housing is coupled to a sealed, pressurized vessel in sealed relationship thereto.

3. A retractable sootblower as defined in claim 1 wherein said housing includes a closed end and further includes an open end through which said blowing tube extends when said blowing tube is in said extended position, and wherein said open end includes a flange mateable with a customer flange included on the pressurized vessel in sealing relationship with the customer flange.

4. A retractable sootblower as defined in claim 3 wherein a portion of said blowing tube projects beyond said flange even when said blowing tube is in said retracted position.

5. A retractable sootblower as defined in claim 1 wherein said blowing tube is moved between said extended position and said retracted position by a pressurized gas.

6. A retractable sootblower as defined in claim 1 further comprising structure for rotating said blowing tube around its axis in response to movement of said blowing tube from said retracted position to said extended position.

7. A retractable sootblower as defined in claim 1 wherein said inlet opening in said blowing tube is positioned on said blowing tube such that said stationary member overlies said inlet opening in said blowing tube for isolating said inlet opening in said blowing tube from the pressurized blowing gas when said blowing tube in said retracted position, and said inlet opening in said blowing tube is communicated with the pressurized blowing gas when said blowing tube is moved away from said retracted position.

8. A retractable sootblower as defined in claim 7 wherein said stationary member comprises a bushing within said housing supporting said blowing tube for axial movement relative to said housing.

9. A retractable sootblower as defined in claim 8 wherein said bushing supports said blowing tube for rotational motion around its axis relative to said housing.

10. A retractable sootblower as defined in claim 9 wherein said blowing tube includes a tip and a discharge opening communicating with the hollow interior of said blowing tube adjacent said tip.

11. A retractable sootblower as defined in claim 10 wherein said blowing tube further includes a nozzle disposed in said discharge opening.

12. A retractable sootblower comprising:

a housing;

an elongate, hollow blowing tube mounted in said housing for movement between an extended position and a retracted position;

a gas inlet in said housing for receiving pressurized blowing gas;

a gas channeling structure within said housing and responsive to the position of said blowing tube for substantially channeling the blowing gas through said blowing tube when said blowing tube is in said extended position and for substantially limiting passage of the blowing gas through said blowing tube when said blowing tube is in said retracted position, said blowing tube being moved between said extended position and said retracted position by a pressurized gas, and second and third gas inlets in said housing for receiving a pressurized actuating gas through one of said second and third gas inlets and for exhausting gas from the housing through the other of said second and third gas inlets as said blowing tube is moved between said extended and retracted positions.

13. A retractable sootblower as defined in claim 12 wherein said blowing tube is extended by applying the pressurized actuating gas to said second gas inlet and exhausting gas from said third gas inlet, and wherein said blowing tube is retracted by applying the pressurized actuating gas to said third gas inlet and exhausting gas from said second gas inlet.

14. A retractable sootblower as defined in claim 13 wherein said sootblower includes a piston movable in said housing and wherein said blowing tube is coupled to said piston.

15. A retractable sootblower as defined in claim 14 wherein said second gas inlet is positioned on one side of said piston and said third gas inlet is positioned on the other side of said piston.

16. A retractable sootblower as defined in claim 15, further including structure coupled to said blowing tube for rotating said blowing tube as said blowing tube moves from said retracted position to said extended position.

17. A retractable sootblower as defined in claim 16 wherein said structure comprises a spiral groove formed in said blowing tube and a guide pin engaging said spiral groove to rotate said blowing tube around its longitudinal axis as said blowing tube slides past said guide pin.

18. A retractable sootblower as defined in claim 13 wherein said sootblower includes an extendable cylinder coupled to said blowing tube.

19. A retractable sootblower as defined in claim 18 wherein said extendable cylinder is coupled to said second and third gas inlets.

20. A retractable sootblower as defined in claim 19 wherein said extendable cylinder includes a cylinder housing and a cylinder rod and further includes structure for rotating said cylinder rod relative to said cylinder housing when said cylinder is extended so that said blowing tube rotates around its longitudinal axis as it moves from said retracted position to said extended position.

21. A retractable sootblower mountable on the customer flange of a pressurized vessel in sealed relationship thereto, said retractable sootblower comprising:

an elongate housing having a closed rear end and an open front end, said front end including a front flange for engaging and securing to the customer flange in sealed relationship therewith;

a piston mounted for axial, reciprocating movement within said housing;

a hollow, elongate blowing tube within said housing having a rear end coupled to said piston and a forward end projectable through said front flange, said blowing tube being axially movable relative to said housing in response to axial movement of said piston;

a center bushing in said housing between said rear end of said housing and said front end of said housing and engaging said blowing tube, said center bushing dividing said housing into a forward chamber and a rear chamber with said piston being contained in, and reciprocable in, said rear chamber and said blowing tube extending through said forward chamber;

a gas inlet for introducing pressurized blowing gas into said forward chamber;

an inlet opening in said blowing tube communicating with the hollow interior of said blowing tube, said inlet opening being positioned on said blowing tube so that said center bushing isolates said inlet opening from said forward chamber when said piston is adjacent said rear end of said housing and said inlet opening is exposed in said forward chamber when said piston is adjacent said center bushing; and structure for controllably moving said piston in said rear chamber toward said center bushing to thereby simultaneously extend said blowing tube relative to said housing and expose said inlet opening in said forward chamber and toward said rear end of said housing to thereby simultaneously retract said blowing tube and isolate said inlet opening from said first chamber.

22. A retractable sootblower as defined in claim 21 further including further structure for rotating said blowing tube around its axis in response to extension of said blowing tube relative to said housing.

23. A retractable sootblower as defined in claim 22 wherein said further structure comprises a spiral groove formed in said blowing tube and a guide pin engaging said groove.

24. A retractable sootblower as defined in claim 23 wherein said guide pin is mounted adjacent said center bushing and engages said groove to rotate said blowing tube as said blowing tube slides past said center bushing.

* * * * *